US005129702A

United States Patent [19]

Ervin

[11] Patent Number: 5,129,702

[45] Date of Patent: Jul. 14, 1992

[54] ADJUSTABLE FOLD-AWAY TABLE HAVING FURNITURE ATTACHMENT BRACKET

[76] Inventor: David Ervin, P.O. Box 2489, New Orleans, La. 70176

[21] Appl. No.: 498,424

[22] Filed: Mar. 26, 1990

[51] Int. Cl.[5] ..... A47B 39/00; A47B 83/02

[52] U.S. Cl. ..... 297/144; 108/49; 248/429

[58] Field of Search ..... 297/144, 145, 162, 192, 297/431, 173, 174, 105, 192, 194, 150, 154, 135; 108/49, 193; 248/429, 430, 424, 425

[56] References Cited

U.S. PATENT DOCUMENTS

| | | | |
|---|---|---|---|
| 1,797,847 | 3/1931 | Vandagriff | 108/49 |
| 1,894,991 | 1/1933 | Hayes | 108/49 |
| 2,375,696 | 5/1945 | Shick | 297/174 |
| 2,546,283 | 3/1951 | Webster | 108/49 |
| 2,609,938 | 9/1952 | Wells | 108/49 |
| 2,612,422 | 9/1952 | Sarkus | 108/49 |
| 2,635,680 | 4/1953 | Zentmire | 297/144 |
| 2,921,825 | 1/1960 | Spiegel | 108/49 |
| 3,543,312 | 12/1970 | Pofferi | 108/49 |
| 3,627,253 | 12/1971 | Germain | 248/429 |
| 3,717,375 | 2/1973 | Slobodan | 297/162 |
| 4,834,449 | 5/1989 | Engelman | 297/150 |
| 4,890,561 | 1/1990 | Hampshire et al. | 108/143 |

*Primary Examiner*—Kenneth J. Dorner
*Assistant Examiner*—James M. Gardner

[57] ABSTRACT

The fold-away table is attached to an underside of a chair, sofa or the like. The fold-away table provides for the use of two parallel rails which are attached to the underside of the chair, along which rails a carriage slides forward and rearward in relation to the chair. One of the rails carries a locking bar with teeth formed on its inner side which match and interlock with teeth of a locking piece carried by the carriage, so as to secure position of the carriage in relation to the chair when extended. The carriage has a table top leg support which pivots to a vertical orientation and which has a table top supported on one of its tubular members. A tilting mechanism carried by the tubular member allows tilting of the table top to an angle most convenient for the user. A release mechanism which is mounted on the forward end of one of the rails is activated by foot of the user, when necessary, to release locking engagement of the locking bar and the locking piece.

25 Claims, 6 Drawing Sheets

ADJUSTABLE FOLD-AWAY TABLE HAVING FURNITURE ATTACHMENT BRACKET

BACKGROUND OF THE INVENTION

The present invention relates to fold-away tables for use with arm chairs, sofas and the like. More particularly, the present invention relates to a fold-away table that is mountable on an underside of a piece of furniture and can be selectively mobile between a stored position underneath the piece of furniture or a second position in front of the piece of furniture.

The idea of providing fold-away tables for use with arm chairs, hospital beds, sofas and the like has been approached by many designers. The fold-away tables are used for positioning dishes of food on the table or as writing surfaces, while a person is comfortably seated in the chair or on the sofa. One of the disadvantages associated with prior designs of fold-away tables is there instability and with the inability of the table surface to be inclined towards or away from the person and lock in that position to allow such activities as writing or reading at an angle most convenient to the user.

The present invention contemplates provision of a fold-away table for use with chairs, sofas and the like which overcomes deficiencies of the prior art.

SUMMARY OF THE INVENTION

The present invention overcomes deficiencies of the prior art and solves its problems in a simple and straightforward manner.

A fold-away table apparatus is provided suitable for securing to the underside of a chair or a sofa.

The apparatus comprises a pair of parallel elongated rails which are secured to extend from the front rearwardly under the chair. A carriage means is mounted between the rail members and comprises at least one cross piece which has sliding plates on both of its ends which are slidably received within channels formed by the rail members to allow sliding of the carriage forward and rearward. One of the rail members carries a locking bar, the inner side of which is provided with a plurality of teeth, while one of the carriage members carries a locking piece which is provided with matching teeth to interlock with the teeth of the locking bar, so as to secure the distance of extension of the carriage in relation to the front of the chair.

A table top leg support is fixedly attached to the tubular member which carries the locking piece, such that pivoting of the leg support to a vertical orientation causes the rotation of the tubular member and locking of the teeth.

The leg support is provided with an outer tubular member and an inner tubular member, the latter being composed of two portions, one of which hinges, when telescopically extended from the outer tubular member, to 90 degrees, extending along the underside of the table top. A tilting mechanism carried by the inner tubular member allows tilting of the table top to the angle most convenient to the user.

The table top, along with the supporting leg can rotate about a horizontal plane up to 90 degrees as to move it away from the front of the chair when the table is in its erected position.

A release mechanism mounted on the forward end of one of the rails is provided with a release bar and a pulling wire which has a second end attached to the locking piece carried by the carriage. By moving the release bar by foot, so as to pull the wire, the user releases the locking engagement of the locking piece and the locking bar.

It is therefore an object of the present invention to provide a fold-away table which is stable and convenient in operation.

It is a further object of the present invention to provide a chair which has easy activated release mechanism to allow folding of the table.

It is a further object of the present invention to provide means for tilting the table top to the desired degree.

It is a further object of the present invention to provide a fold-away table which can be extended in relation to the front of the chair to the desired distance and locked in that position.

These and other objects of the present will be more apparent to those skilled in the art from the following description of the preferred embodiment.

BRIEF DESCRIPTION OF THE DRAWINGS

Referring to the drawings, wherein like parts are designated by like numerals.

DETAILED DESCRIPTION OF THE PREFERRED EMBODIMENT

Figure 1:
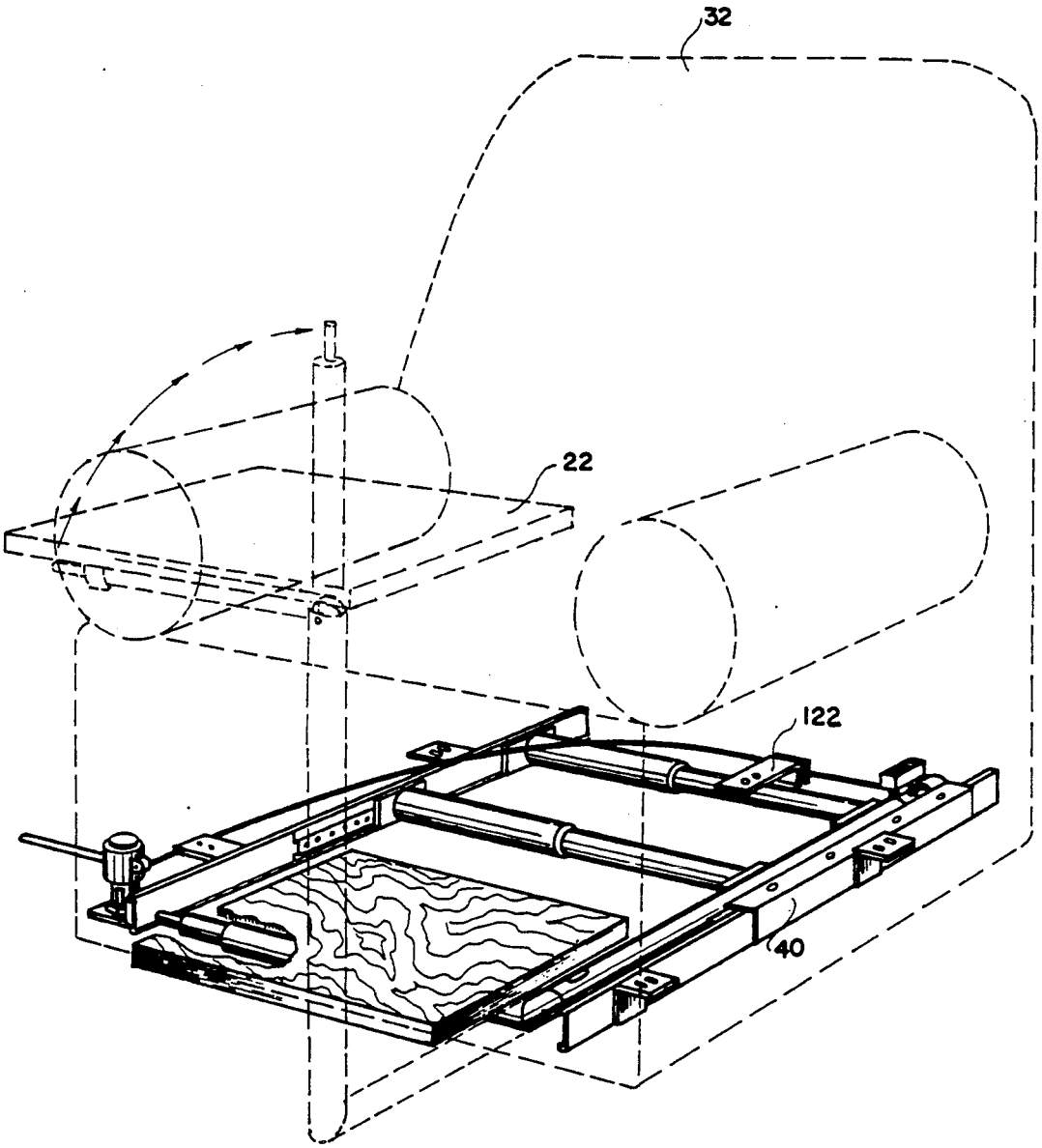
FIG. 1 is a perspective view of the fold-away table in accordance with the present invention as mounted on a chair.

Turning now to the drawings in more detail, the fold-away table in accordance with the present invention is generally designated by numeral 10. The table apparatus 10 comprises a pair of lateral parallel rail members 12 and 14, a carriage 16, a locking means 18, a locking means release mechanism 20 and a table top 22.

Figure 2:
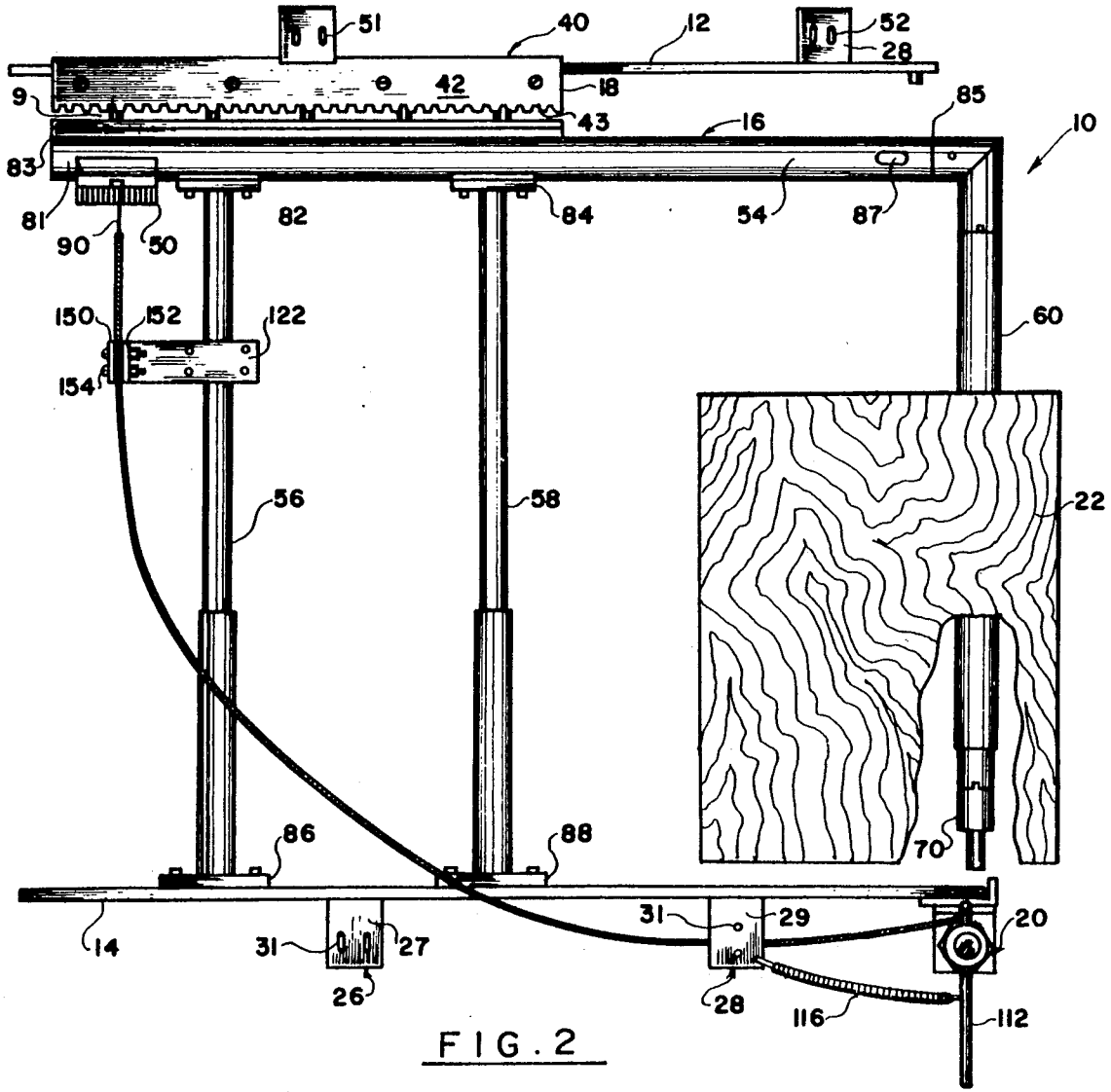
FIG. 2 is a perspective, partially cut-away view of the fold-away table in accordance with the present invention, in a folded position.
Figure 8:
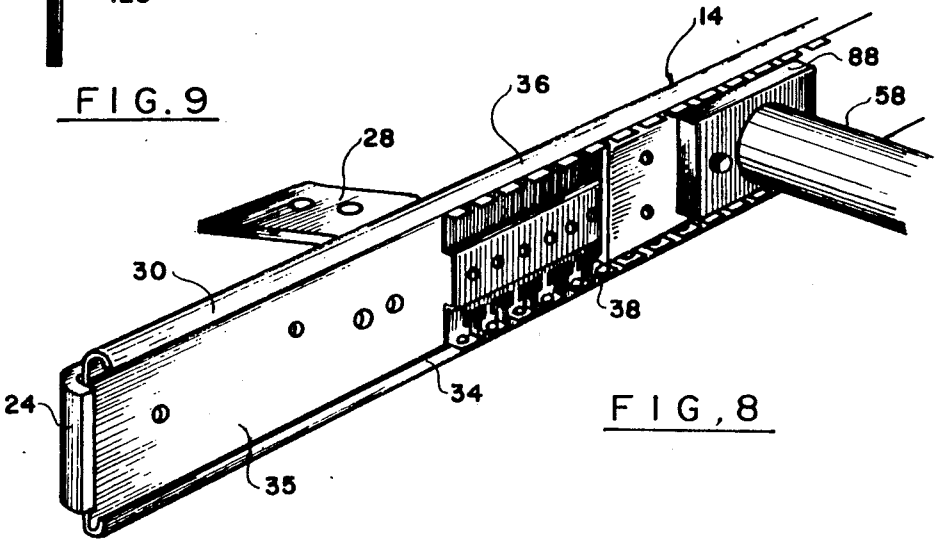
FIG. 8 is a detail view of a carriage rail.

The rail member 14, as can be seen in FIGS. 1, 2 and 8, includes an angular plate 24 which is securely attached, such as by welding or bolting, to an elongated rail bar 30. The plate 24 is bent at a right angle in such a manner that one part of it extends at a right angle to the longitudinal axis of the elongated bar 30, while the other part is angled and is attached to the exterior of the bar 30. The second portion serves as an attachment plate for the release mechanism 20, as will be described below. The rail bar 30 has an upper downwardly curved lip 36 and a lower upwardly turned lip 34 which form a generally U-shaped channel 35 on the interior side of the bar 30. Mounted within the channel 35 is a ball bearing insert 38, which has ball bearings mounted on its upper, bottom and central surfaces in order to ensure a smooth sliding of the cross members of the carriage 16.

Securely attached to the exterior side of the rail bar 30 are attachment angular plates 26 and 28 which are spaced from each other and which have a vertical portion extending in parallel relationship and in frictional contact with exterior of the rail bar 30, as well as an upper perpendicularly extending portions 27 and 29, respectively, which extend outwardly from the rail bar 30 as can be seen in FIGS. 1, 2 and 8. The portions 27 and 29 are provided with openings 31 which allow passing of a screw or bolt, or similar attachment means therethrough for attachment of the rail member 14 to the underside frame of a chair 32.

The rail bar 12 has substantially similar elongated bar with upwardly and downwardly curving lips which form a U-shaped channel on the interior side of the bar 12. Although not shown in the drawings, a ball bearing insert is also provided within the channel formed by the rail bar 12.

Securely attached proximate the rearward end of the rail bar 12 is the locking bar 40 which has a vertically extending wall 41, an inwardly perpendicularly angled top wall 42 and downwardly extending interior wall 43. The walls 43 and 41 are parallel to each other. The top wall 42 is fixedly attached, such as by screws or by welding, to the rail bar 12. The interior wall 43 is provided with the plurality of elongated teeth 46 which extend from the top edge of the wall 42 downwardly. The width of the top wall 42 is greater than the total width of the top edge of the bar 12, so that the teeth 46 extend inwardly from the U-shaped channel formed by the rail bar 12 and not interfere with the sliding movement of the carriage 16.

Fixedly attached to the wall 41 of the locking bar 40 is an angular attachment plate 49 which, similar to the plate 26 is provided with openings 51 suitable for attachment to the underside of the chair frame. A second attachment plate is secured proximate the forward end of the rail bar 12 and is designated by numeral 52 in the drawings. Similarly, it is also provided with openings 53 through which a screw or bolt can be passed for attachment to the frame of the chair 32.

The carriage means 16 comprises an elongated tubular lateral member 54, a rear cross member 56, a forward cross member 58 and a leg support member 60, which occupies the most forward position in the apparatus 10 as shown in FIGS. 1 and 2.

Figure 3:
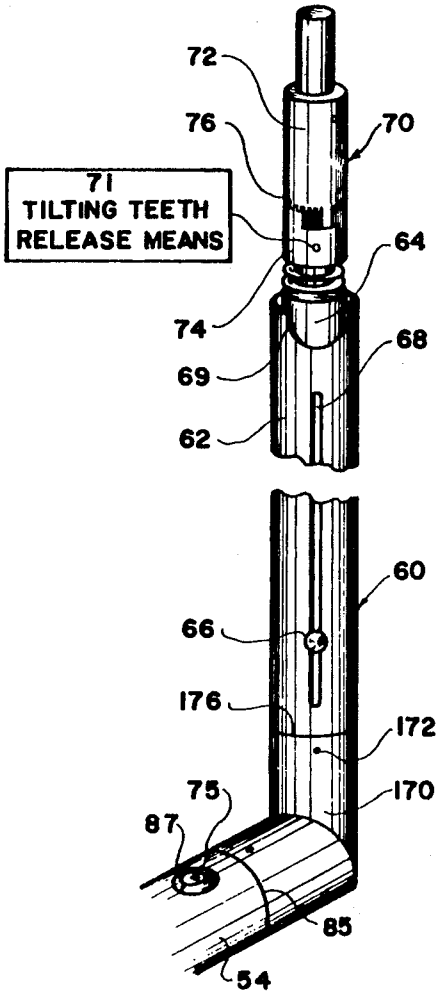
FIG. 3 is a perspective detail view of a table leg support.

Reference will now be made to FIG. 3 illustrating a detail view of the leg support member 60. As can be seen in the drawing, the leg support 60 comprises an outer tubular member 62 which encircles an inner tubular member 64. The inner tube 64 is adapted for sliding co-axial movement within the outer tube 62, to a limited extent. A slot 68 is formed through the wall of the outer tube 62 through which a head of the screw 66 projects The screw or bolt 66 engages the inner tube 64, so as to limit movement of the tube 64 within the tubular member 62 by the lowermost and uppermost limits of the slot 68.

Figure 12:
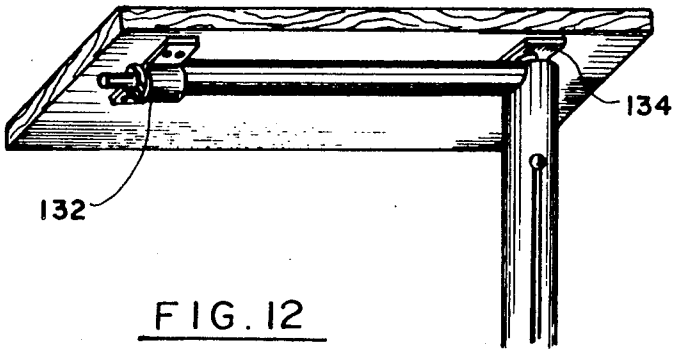
FIG. 12 is a detail view illustrating the underside of the table top.
Figure 13:
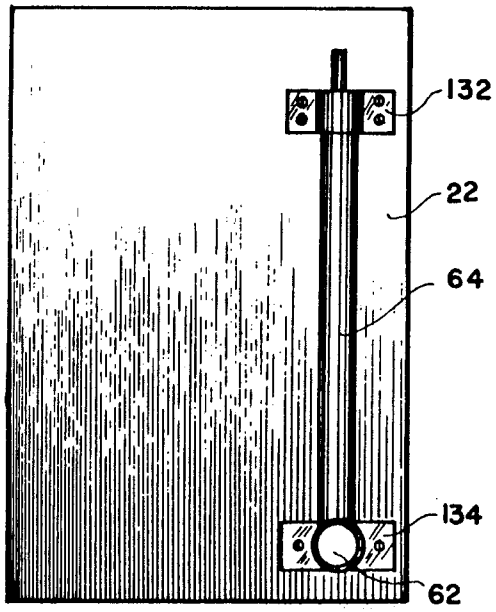
FIG. 13 is a bottom view of the table top.

The inner tube 64 has two parts which are moved together within the tube 62. However, when the tube 64 reaches its uppermost position and the screw 66 engages the upper limits of the slot 68, the upper part of the tube 64, being pivotally connected to the lower part, can bend at 90 degrees to form a support for a table top 22. A semi-circular cutout groove 69 in the upper end of the tubular member 62 allows the 90 degree bend of the tube 64 in that location (see FIGS. 10 and 12).

The uppermost cylindrical part of the leg support member 60 is designated by numeral 70 in the drawings and is shown to be comprised of a lower portion 74 and an upper portion 72. A plurality of teeth-like cutouts are made in the portions 72 and 74 about the circumference of the two portions at the point of their engagement. The teeth of both portions are designated by numeral 76 in the drawings and are seen as intermeshed with each other. By slightly inclining the upper movable portion 72 in relation to a stationary lower portion 74, the table top 22 can be tilted towards or away from the user to the desired angle, when necessary. Normally, the teeth 76 are locked in their mutually meshed position. To allow tilting of the table top, a tilting teeth release means 71 is activated to release locking engagement of the teeth 76 and allow rotation of one of the portions to the desired degree.

Figure 5:
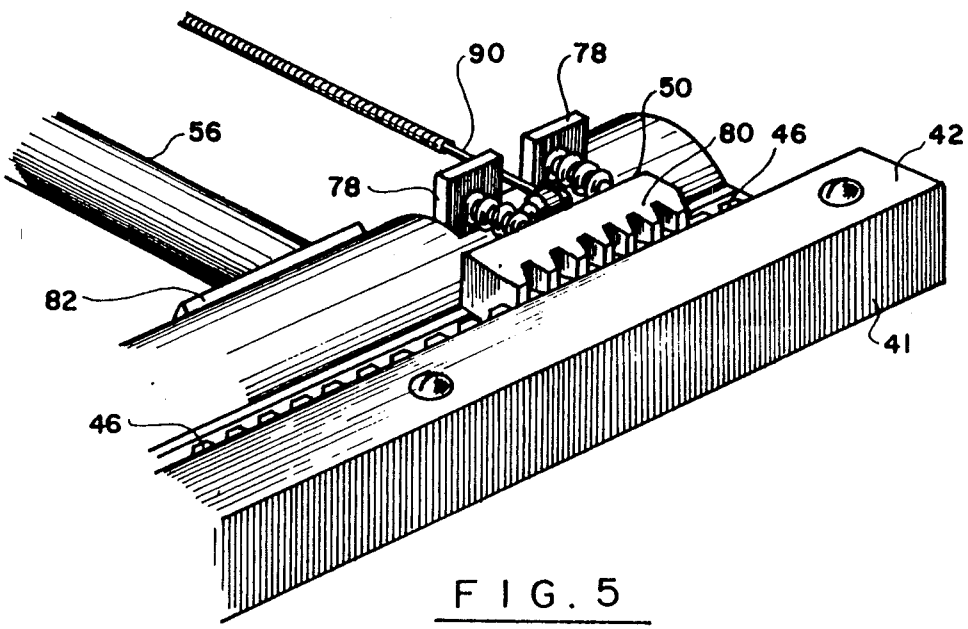
FIG. 5 is a detailed perspective view similar to FIG. 4, but wherein the carriage locking mechanism is in a locked position.
Figure 4:
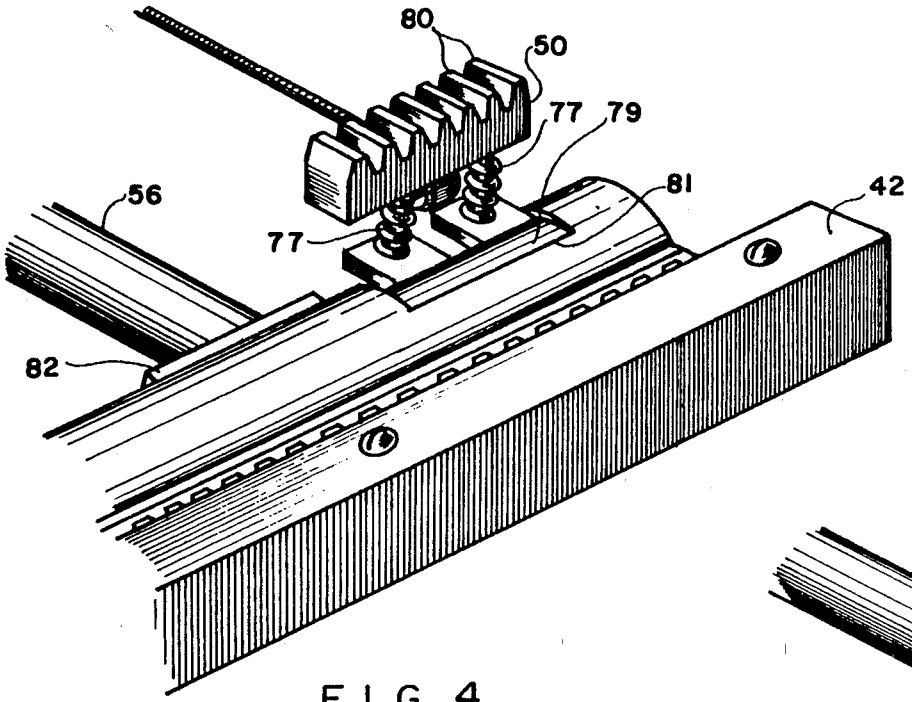
FIG. 4 is a perspective view of a carriage locking mechanism in an unlocked position.

Reference will now be made to FIGS. 4 and 5, illustrating a locking mechanism of the fold-away table in accordance with the present invention.

As was described above, the locking bar 40 is provided with a plurality of teeth 46 formed on the inner wall 43 thereof. A locking piece 50 having a plurality of matching teeth 80 on the front surface is provided for engagement with the teeth 46 of the locking bar 40. The locking piece 50 is supported on one or more pins 77, the free ends of which are supported by one or more attachment plates 78. The plates 78 are rigidly attached, such as by welding to the exterior wall of an inner tubular member 79 substantially perpendicularly to the longitudinal axis thereof.

The inner tubular member 79 is positioned within the carriage tubular element 54 and is adapted for a rotational movement therein. A suitable cutout 81 is formed in the wall of the tubular element 54 proximate to its rear end, so as to expose the inner tube 79 and allow attachment of the locking piece 50.

The locking piece 50 is adapted for movement between a position, in which the teeth 80 are intermeshed with the matching teeth 46 of the locking bar 40 to form a rack and a position, wherein the teeth 80 are out of engagement with the teeth 46. The pivotal movement to the locking piece 50 is transmitted through a pulling wire 90 which is attached at one of its ends to the side of the locking piece 50 opposite to the surface which carries the teeth 80.

When the carriage 16 slides forward or backward in relation to the rail members 12 and 14, the teeth 80 and 46 are not engaged, allowing adjustment of the position of the table top 22 to the most convenient for the user. Once this most convenient position is reached and the leg support 60 is extended to a desired distance to the front of the chair 32, the leg support member 60 is pivoted about a pivotal connection line 85 (best seen in FIG. 2), turning the inner tube 79, which is rigidly attached to the leg support 60, up to 90 degrees, bringing the teeth 80 in alignment and engagement with the corresponding matching teeth 46, as illustrated in FIG. 5.

As will be appreciated, the teeth 46 and 80 are not engaged with each other while the leg support 60 lies horizontally or generally about the same plane as the remainder of the carriage 16.

To insure a locked secure position of the table support 60 in relation to the carriage 16, a depressible knob 75 is fixedly attached to the exterior of the inner tube 79 in alignment with a cutout slot 87. When the knob is depressed, the tube 79 easily rotates within the outer tubular member 54 in response to pivotal movement of the leg support 60. However, when the depressed spring operated knob 75 is aligned with the opening 87, it is pushed outwardly from the interior tube 79, projecting through the slot 87 and preventing further rotation of the tube 79. By depressing the knob to a level below the depth of the wall of the tube 54, the leg support 60 can be lowered down, rotating, to about 90 degrees, the inner tube 79, once again returning the fold-away table 10 to its folded position.

The cross members 56 and 58 are attached perpendicularly to a longitudinal axis of the tubular member 54 through attachment plates 82 and 84, respectively.

Opposite ends of the cross members 56 and 58 are provided with sliding plates 86 and 88 which are engagable within the U-shaped channel of the rail bar 14 and are adapted for longitudinal movement therein. On diametrically opposite of the tubular member 54 carries one or more longitudinal plates 83 which extend from the edge of the tubular member 54 to a distance approximating the length of the locking bar 40. Fixedly secured to the plates 83 are a plurality of sliding members 89 which are engagable within the U-shaped channel of the rail bar 12. In this manner, the sliding movement of the carriage 16 is stable and even, providing a reliable support to the leg 60 by distributing the weight deposited on the table top 22 between the two parallel spaced-apart rails 12 and 14.

Figure 7:
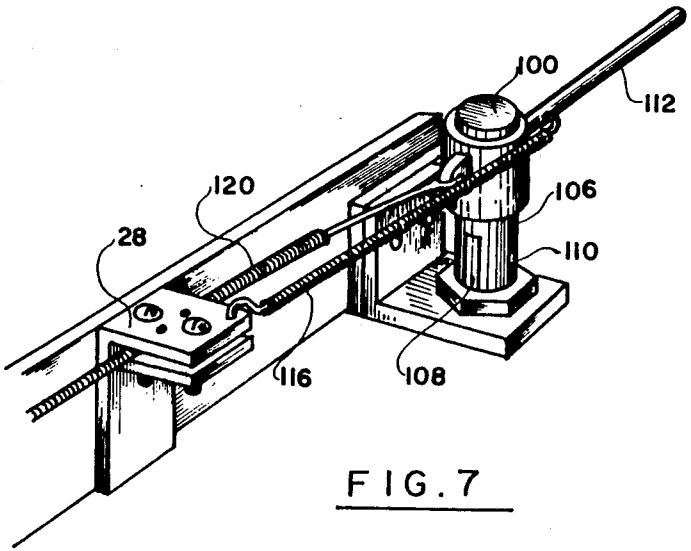
FIG. 7 is a detail view of the locking release mechanism in a release position.
Figure 6:
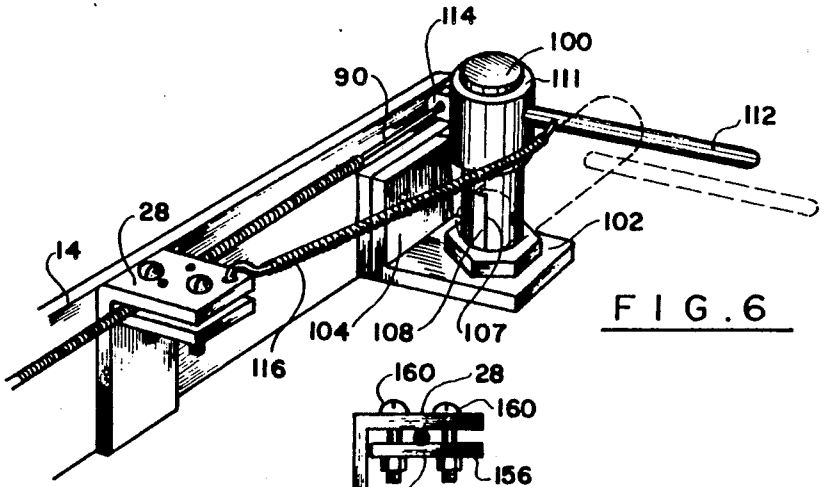
FIG. 6 is a detailed perspective view of a locking release mechanism in a secured position.

Reference will now be made to FIGS. 6 and 7 illustrating a lock release mechanism of the apparatus in accordance with the present invention. As was described above, the pull wire 90 is attached at one of its ends to the locking piece 50. The wire 90 extends along the carriage 16 and along the rail member 14 towards the front of the rail member 14, wherein it is seen to be attached to a release means 100. The release means 100 is supported on an attachment plate 102 which is integrally connected to a perpendicularly angled attachment piece 104. As better seen in FIGS. 6 and 7, the attachment piece 104 is secured, such as by bolts or by welding to the plate 24 and more specifically to the rearwardly extending portion thereof As will be appreciated, the forwardly extending portion of the plate 24 serves as an absolute limit of forward movement of the carriage 16 along the rail 14, preventing the sliding member 88 from full disengagement from its engagement within the channel 35. The rail bar 12 can be suitably provided with a stop limitation means, such as bolt or screw 140 mounted perpendicularly and extending inwardly from the interior of the rail bar 12 into the channel formed thereby, so as to prevent movement of the sliding members 89 past the forwardmost limits of the rail bar 12.

The release means 100 comprises a lower portion which is formed by a cylindrical part 106 having rectangularly-shaped cutouts 107 on diametrically opposite sides thereof which encloses a stationary piece 108. The lower portion 106 is pivotally mounted on the stationary piece 108 and can swivel forwardly to 90 degrees, while retaining its engaged position with the stationary piece 108 through the use of the retaining pin 110.

Circumferentially mounted about the cylindrical part 106 is a sleeve 111 which is rotationally mounted on the cylindrical part 106 in tight frictional engagement. Fixedly attached to the sleeve 111 and projecting outwardly therefrom is a release bar 112 which extends perpendicularly to the longitudinal axis of the sleeve 111. A loop 114 is fixedly attached to a diametrically opposite side of the sleeve 111, the loop having the pulling wire 90 secured thereto.

A tension spring 116 is attached at one of its ends to the release bar 112 and is attached at its second end to the attachment plate 28, normally pulling the release bar 112 towards the plate 28.

When the user is seated in the chair 32 and wants to adjust the table along a horizontal plane, i.e. move towards or away from the chair front end, he may release the locking engagement of the teeth 80 and 46 by imparting a pivotal force on the release bar 112 against the strength of the spring 116. This action causes the bar 112 to rotate the sleeve 111, thus pulling the wire 90, which pulling force is transmitted to the second end of the wire 90 and to the locking piece 50, disengaging the teeth 80 from the teeth 46.

To prevent damage to the underside of the chair 32 and deformation of the wire 90 during a folding operation, the pulling wire 90 is covered by a sleeve 120 which is conveniently passed under the attachment plate 28 and is fixedly engaged with a securing bar 122 shown in FIGS. 1 and 2, proximate one end, and fixedly attached to the attachment plate 28 proximate its other end. The sleeve 120 is secured between two parallel plates 150 and 152 by tightening screws 154 passing through co-aligned opening formed in the plates 150 and 152, so that the sleeve 120 is "sandwiched" between the plates. The attaching plate 28 carries on its underside a similar tightening parallel plate 156 which is secured to the portion plate 28 by tightening screws 160. In this manner, when the wire 90 is forced to move, it has a limited "flexing" ability, which saves the wire 90 from bending and deformation.

Figure 9:
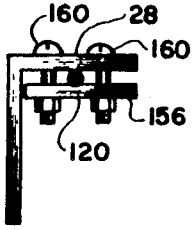
FIG. 9 is a detail view of the wire guide.
Figure 11:
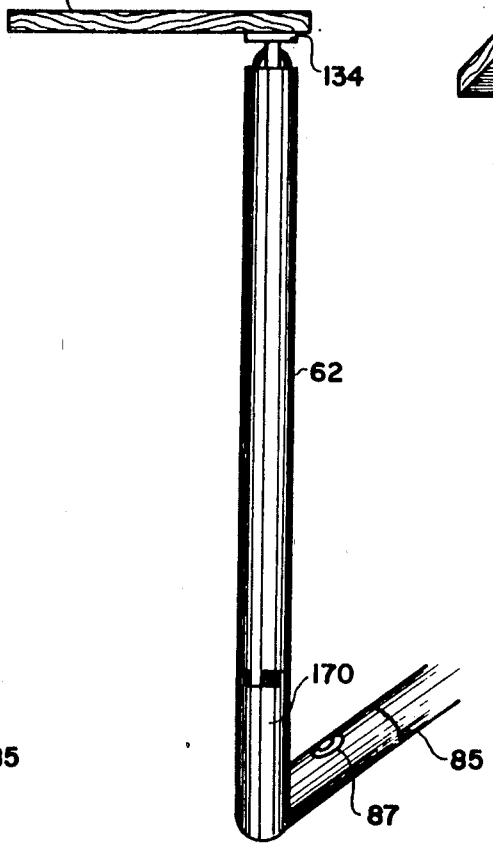
FIG. 11 is a view similar to the view of FIG. 10 the table top rotated to 90 degrees along a horizontal plane.
Figure 10:
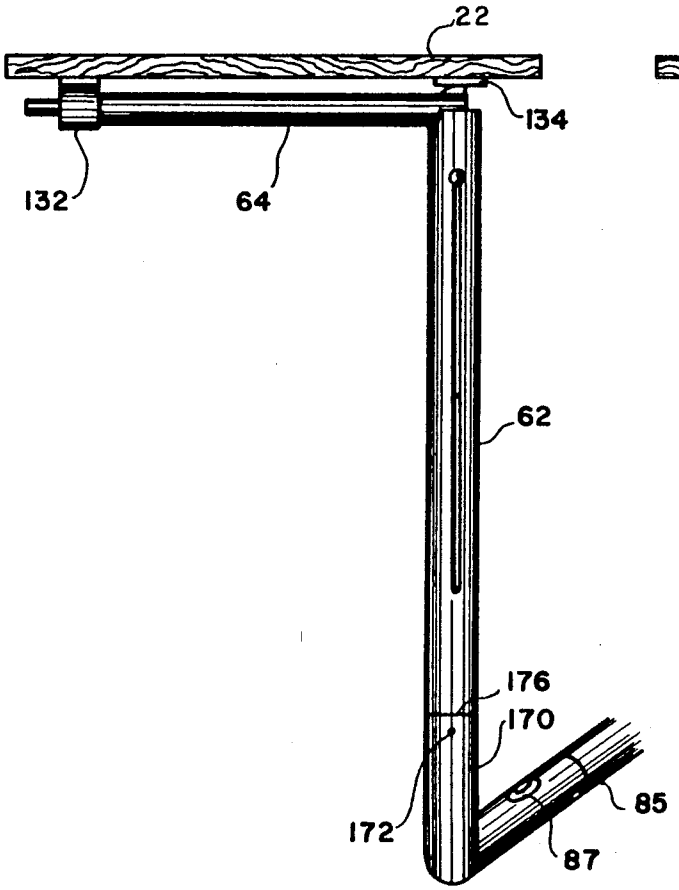
FIG. 10 is a perspective detail view illustrating the table top on the leg support in a regular position.

Reference will now be made to FIGS. 9, 10, and 11, illustrating the table top 22 and the manner of its positioning during use as a supporting surface.

As was described above, the interior tubular member 64 is telescopically extended from its enclosed position within the outer tubular member 62 until such time as a hinged end 130 is exposed above the upper edge of the outer member 62. The interior tubular member 64 is then hinged or pivoted 90 degrees to a position substantially perpendicular to the longitudinal axis of the outer tubular member 62, with a portion of the interior member 64 resting on the cutout edge 69.

As is shown in the drawing, the table top 22 is securely attached to the tilting mechanism 70 with the help of a bracket 132 which has a circular portion in which the cylindrical tilting mechanism 70 rests.

In order to prevent damage to a wooden or plastic surface of the table top 22, a flat protective plate 134 is attached to the underside of the table 22 at a location aligned with a hinged connection between the inner tubular member 64 and outer tubular member 62. Additionally, in this manner, the table top 22 rests on the interior tubular member 64 at a level co-aligned with the outer tubular member 62, since the protective plate 134 is of a thickness to make up for the space between a bent tubular member 64 and the under-surface of the table top 22.

Figure 14:
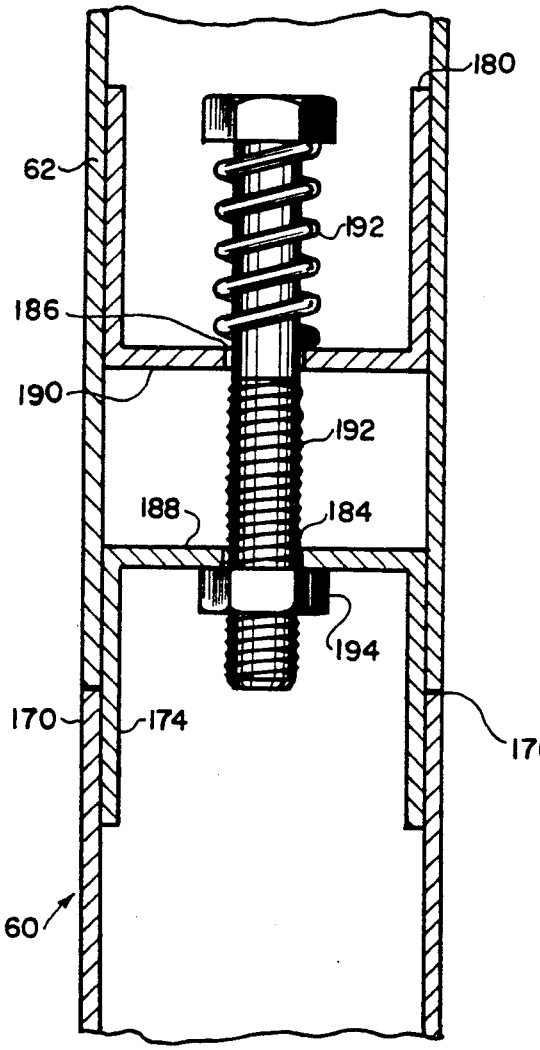
FIG. 14 is cross sectional detail view of the leg support rotating means.
Figure 15:
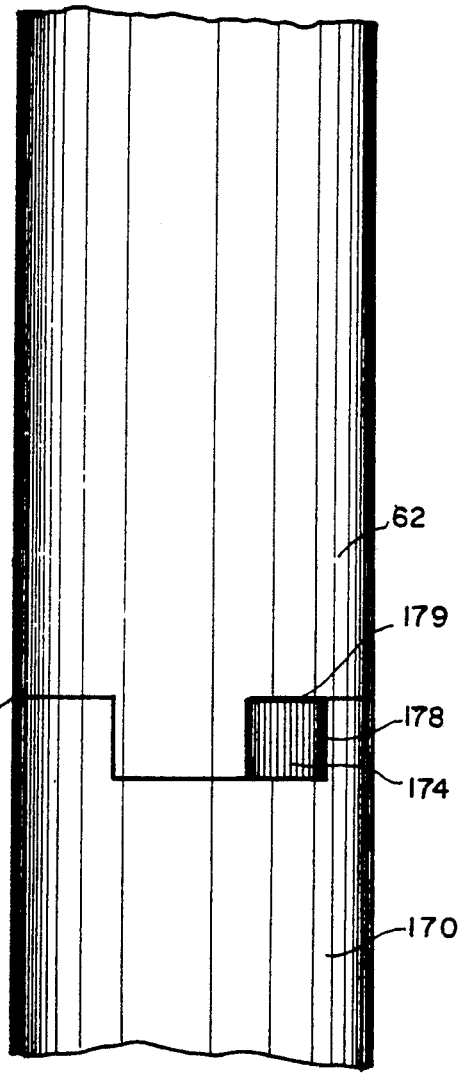
FIG. 15 is a perspective detail view of a leg support member.

Referring now to FIGS. 14 and 15, the rotating means will be addressed as shown in the drawings, the leg support member 60 has a first portion 62 and a second portion 170. The portion 170 is securely attached, such as by screw or pin 172 to the inner inverted U-shaped cylindrical insert 174 which has longitudinal dimensions sufficient to extend from a position below a line of attachment 176 of the portions 62 and 170 to a position above that line.

A cutout groove 178 is formed adjacent the uppermost edge of the portion 170, the groove 178 serving as a means to limit axial rotation of the portion 62 in relation to the portion 170. A matching cutout 179 is formed in the lowermost edge of the portion 62 to allow frictional engagement of the portion 62 with the cutout 178.

A second U-shaped cylindrical insert 180 is positioned within the portion 62 a distance from insert 174, a bolt 182 secures the two inserts 174 and 180 in a spaced relationship by passing through co-aligned holes 184 and 186 formed in facing members 188 and 190 of the inserts 174 and 180, respectively. A spring coil 192 is mounted on the portion of the bolt 182 which extends through the insert 174. The walls of holes 184 and 186 are not threaded allowing the bolt 182 to freely rotate in relation to the insert 174 while preventing disengagement of the portions 62 and 170. The portion 62 rotates to a certain degree in relation to the portion 172, the degree of rotation being limited by the limits of the cutout portions 178 and 179.

When a person seated in a chair 32 wishes to move the table top 22 from a position in front of the chair (as shown in FIG. 10) he pushes against the table top 22 moving it away to 90 degree to a position shown in FIG. 11, while the portion 62 axially rotates about a line of engagement 176.

A reverse procedure brings the table top 22 towards the chair to a position shown in FIG. 10.

In operation, the fold-away table 10 is secured to the underside of the chair 32, with the table top 22 resting in a horizontal orientation as illustrated in FIG. 1. When the table needs to be extended, a person sitting within a chair 32 pulls the table top 22 forward in a horizontal plane, extending the table top to a desired position in front of the chair, the user then pivots the leg support means 60 until it reaches its vertical orientation and a depressible knob 75 (not shown) is forced by spring out of the slot 87. At the same time, the teeth 80 of the locking piece 50 interlock with the teeth 46 of the locking bar 40, securely positioning the leg support 60 in its vertical position. As will be appreciated, the bending or damage to the carriage 16 is eliminated, since the carriage slides within two parallel rails 12 and 14, instead of one rail, as is the case with some of the prior art fold-away tables.

Subsequently, the inner tubular member 64 is telescopically extended upwardly exposing the hinge connection 130 and pivoted perpendicularly to the leg support 62, so that the table top 22 is in a substantially horizontal position in relation to the seat of the chair 32.

The tilting mechanism 71 is manually activated, tilting the top surface of the table top 22 to the desired angle, making it more convenient for the user to write or to read.

When the table 10 needs to be folded-away under the chair, the user, seated in the chair 32 has to make sure that the table top 22 clears the front end of the chair.

If the table top 22 is too close, the release mechanism 20 is activated to move the table top farther away from the chair 32. The depressible knob 75 is then pushed in, while the leg support member 60 is pivoted downwardly to a horizontal position proximate to the floor. The teeth 46 and 80 are disengaged and the carriage 16 is moved back under the chair 32. Many changes and modifications can be made within the design of the apparatus of the present invention without departing from the spirit thereof.

I therefore pray that my rights to the present invention be limited only by the scope of the appended claims.

I claim:

1. A fold-away table for use with a chair, comprising:

a means for attaching said table to an underside frame of the chair;

a pair of parallel spaced-apart rail members fixedly secured to said attachment means and extending from a front of the chair rearwardly under the chair;

a carriage means mounted in sliding engagement between said rail members for sliding movement along said rail members, said carriage means comprising a first elongated tubular member extending in parallel relationship to said rail members, a second elongated tubular member mounted inside said first tubular member, and wherein one end of said second tubular member is fixedly attached to a table top leg support means;

a table top leg support means carried by a foremost portion of said carriage means and movable between a first fold-away position and a second position vertically extending in front of the chair;

a means for locking said carriage means in a plurality of selected positions in relation to said rail members, said locking means comprising an elongated locking bar fixedly attached to one of said rail members, said locking bar having an inner side provided with a plurality of teeth, and a locking piece having a plurality of matching teeth on one side thereof, said locking piece being fixedly attached to said second tubular member and movable into a locking engagement with the teeth of the locking bar in response to rotational movement of said second tubular member when the table top leg support means is pivoted into a vertical position;

means for securing said table top leg support means in its second position;

means for releasing said carriage means from its locked engagement with respect to said rail members; and a table top mounted on said leg support means, said table top being adapted to tilt to a desired angle with respect to horizontal plane when said leg support means is in its second position.

2. The apparatus of claim 1, wherein said carriage means further comprises at least one cross member having a sliding plate mounted on each end thereof, said rail members each having a channel formed on either side thereof, and wherein said sliding plates are slidably engaged within said channels.

3. The apparatus of claim 1, wherein said release means comprises a release mechanism mounted on the second of said rail members adjacent to a forward end of said second rail member, and a pulling wire secured at one of its ends to said release mechanism and secured at its other end to said locking piece.

4. The apparatus of claim 3, wherein the release mechanism comprises a cylindrically shaped pivotal element having a lower portion and an upper portion, said lower portion having a diametrical slot extending from a bottom end of the lower portion of the pivotal element to a distance upwardly, a substantially rectangular stationary insert fitted within said diametrical slot, about which said pivotal element swivels to a maximum of 90 degrees, and a substantially cylindrical sleeve rotationally mounted about said upper portion.

5. The apparatus of claim 4, wherein said release mechanism is further provided with a release bar fixedly attached to said sleeve and extending outwardly therefrom in perpendicular relationship to the longitudinal axis of said cylindrical element, a loop secured to said sleeve on diametrically opposite side from said release bar, and wherein said pulling wire is secured to said loop such that a rotational force imparted on said sleeve through said release bar is transmitted as a pulling force on said wire, releasing said locking piece from its engagement with the locking bar.

6. The apparatus of claim 5, wherein said release mechanism is provided with a tension spring attached at one of its ends to said release bar and attached at its second end to said attaching means, so as to prevent free rotation of said sleeve prior to application of the rotational force.

7. The apparatus of claim 1, wherein said table top leg support means comprises an outer tubular member, one end of which is pivotally attached to said carriage means, and an interior tubular member co-axially slidably movable inside said outer tubular member, and a tilting means for tilting the table top to a desired angle towards or away from a user.

8. The apparatus of claim 7, wherein said outer tubular member is provided with an elongated slot in its wall formed in a substantially parallel relationship to a longitudinal axis of the outer tubular member, and wherein a screw is fixedly secured to said interior tubular member with a head of the screw projecting through said slot.

9. The apparatus of claim 8, wherein said interior tubular member comprises a first part and a second part hingedly attached to said first part, and wherein said second part is telescopically extended from the outer tubular member to allow pivoting of said second part in relation to said first part and said outer tubular member at a right angle.

10. The apparatus of claim 7, wherein said tilting means comprises a cylindrical element having two portions, each provided with interlocked matching tilting teeth and a tilting teeth release means which, when activated, releases locking engagement of the teeth, thus allowing rotation of one of the portions to a desired degree.

11. The apparatus of claim 10, wherein said table top is securely attached to said rotatable portion of said tilting mechanism cylindrical element.

12. The apparatus of claim 11, further comprising means for axially rotating said table top, leg support means.

13. The apparatus of claim 12, wherein said means for axially rotating comprise a tubular member having a first portion and a second portion co-axially joined together along adjoining parts, a first cylindrical insert fixedly secured inside said second portion and extending between said first and said second portions;

a second cylindrical insert secured within said first portion a distance from said first insert;

said first and said second inserts being each provided with a circular cross member which forms a bottom for the insert;

said cross members being each formed with a central opening;

a retaining means for retaining the inserts in a spaced-apart relationship, said retaining means extending through the openings formed in the cross members in such a manner as to permit rotation of the first portion about it longitudinal axis in relation to said second portion.

14. The apparatus of claim 13, wherein said retaining means comprises a bolt having one part thereof extending into said first insert and a tension spring mounted about said part of the bolt, with one end of the spring urging against a bottom of the first insert, a second part of the bolt extending into the second insert, said second bolt part carrying a retaining nut thereon.

15. The apparatus of claim 14, wherein said first portion of the tubular member is provided with a cutout groove and a second portion is provided with a cutout groove which fittingly matches the groove of the first portion, so as to permit matching engagement of the adjoining parts, while permitting a limited rotation of the first portion in relation to the second portion.

16. A fold-away table for use with a chair, comprising:

a means for attaching said table to an underside frame of the chair;

a pair of parallel spaced-apart rail members fixedly secured to said attachment means and extending from in front of the chair rearwardly under the chair;

a carriage means mounted in sliding engagement between said rail members for sliding movement along said rail members, said carriage means comprising a first elongated tubular member extending in parallel relationship to said rail members, a second elongated tubular member mounted inside said first tubular member and adapted for a limited rotation therein, at least one cross member having a sliding plate mounted on each end thereof, said rail members each having a channel formed on inner side thereof, and wherein the sliding plates are slidably engaged within said channels;

a means for locking said carriage means in a plurality of selected positions in relation to said rail members, and said locking means comprising an elongated locking bar fixedly attached to one of said rail members, said locking bar having an inner side provided with a plurality of teeth, and a locking piece having a plurality of matching teeth on one side thereof, said locking piece being fixedly attached to said second tubular member of said carriage means and movable into a locking engagement with the teeth of the locking bar in response to a rotational movement of said second tubular member;

a table top leg support means carried by a foremost portion of said carriage means and movable between a first fold-away position and a second position vertically extending in front of the chair, said table top leg support means comprising an outer tubular member, one end of which is pivotally attached to said carriage means, an interior tubular member co-axially slidably movable inside said outer tubular member and a tilting means for tilting a table top to a desired angle towards or away from the user;

a table top mounted on a free end of said leg support means, said table top being adapted to tilt to a desired angle with respect to a horizontal plane when said leg support means is in its second position;

means for securing said table top leg support means in its second position comprising a depressible knob extended through a slot formed in the outer tubular member of said carriage means; and means for releasing said carriage means from its locked engagement with respect to said rail members, said release means comprising a release mechanism mounted on the second of said rail members adjacent a forward end of said second rail member and a pulling wire secured at one of its ends to said release mechanism and secured at its other end to said locking piece.

17. The apparatus of claim 16, wherein said release mechanism comprises a cylindrically-shaped pivotal element having a lower portion and an upper portion, said lower portion having a diametrical slot extending from a bottom end to a distance upwardly, a substantially rectangular stationary insert fitted within said diametrical slot about which said pivotal element swivels to a maximum of 90 degrees and a substantially cylindrical sleeve rotationally mounted about said upper portion.

18. The apparatus of claim 17, wherein said release mechanism is further provided with a release bar fixedly attached to said sleeve and extending outwardly therefrom in perpendicular relationship to a longitudinal axis of said cylindrical element, a loop secured to said sleeve on diametrically opposite side from said release bar, and wherein said pulling wire is secured to said loop such that a rotational force imparted on said sleeve through said release bar is transmitted as a pulling force on said wire, releasing said locking piece from its engagement with the locking bar.

19. The apparatus of claim 18, wherein said release mechanism is provided with a tension spring attached at one of its ends to said release bar and attached at its second end to said attaching means, so as to prevent free rotation of said sleeve prior to application of the rotational force.

20. The apparatus of claim 19, wherein said table tilting means comprises a cylindrical element having two portions, each provided with interlocked matching tilting teeth and a tilting teeth release means which, when activated, releases locking engagement of the teeth, thus allowing rotation of one of the portions to a desired degree.

21. The apparatus of claim 16, further comprising means for axially rotating said table top leg support means.

22. The apparatus of claim 16, wherein said retaining means comprises a bolt having one part thereof extending into said first insert and a tension spring mounted about said part of the bolt, with one end of the spring urging against a bottom of the first insert, a second part of the bolt extending into the second insert, said second bolt part carrying a retaining nut thereon.

23. The apparatus of claim 16, wherein said means for axially rotating comprise a tubular member having a first portion and a second portion co-axially joined together along adjoining parts, a first cylindrical insert fixedly secured inside said second portion and extending between said first and said second portions;

a second cylindrical insert secured within said first portion a distance from said first insert;

said first and said second inserts being each provided with a circular insert cross member which forms a bottom for the insert;

said insert cross members being each formed with a central opening;

a retaining means for retaining the inserts in a spaced-apart relationship, said retaining means extending through the openings formed in the insert cross members in such a manner as to permit rotation of the first portion about its longitudinal axis in relation to said second portion.

24. The apparatus of claim 23, wherein said first portion of the tubular member is provided with a cutout groove and a second portion is provided with a cutout groove which fittingly matches the groove of the first portion, so as to permit matching engagement of the adjoining part, while permitting a limited rotation of the first portion in relation to the second portion.

25. A fold-away table for use with a chair, comprising:

a means for attaching said table to an underside frame of the chair;

a pair of parallel spaced-apart rail members fixedly secured to said attachment means and extending from a front of the chair rearwardly under the chair;

a carriage means mounted in sliding engagement between said rail members for sliding movement along said rail members, said carriage means comprising a first elongated tubular member and a second elongated tubular member;

a table top leg support means carried by a foremost portion of said carriage means and movable between a first fold-away position and a second position vertically extending in front of the chair;

a table top mounted on said leg support means, said table top being adapted to tilt to a desired angle with respect to a horizontal plane when said leg support means is in its second position; and a means for locking said carriage means in a plurality of selected positions in relation to said rail members, so as to maintain the table top at multiple stable positions, said locking means comprising an elongated locking bar fixedly attached to one of said rail members, said locking bar having an inner side provided with a plurality of teeth, and a locking piece having a plurality of matching teeth on one side thereof, said locking piece being fixedly attached to said second tubular member and movable into a locking engagement with the teeth of the locking bar in response to rotational movement of said second tubular member.

* * * * *